United States Patent [19]

Douglas

[11] Patent Number: 4,616,864

[45] Date of Patent: Oct. 14, 1986

[54] FASTENERS FOR DOORS, WINDOWS AND THE LIKE

[75] Inventor: Jack E. Douglas, Stratford-on-Avon, England

[73] Assignee: Hardware & Systems Patents Limited, London, England

[21] Appl. No.: 662,173

[22] Filed: Oct. 18, 1984

[30] Foreign Application Priority Data

Oct. 22, 1983 [GB] United Kingdom ..... 8328302

[51] Int. Cl.[4] ..... E05C 9/12

[52] U.S. Cl. ..... 292/336.3; 292/39

[58] Field of Search ..... 292/336.3, 39, 142, 292/172, 51, 199

[56] References Cited

U.S. PATENT DOCUMENTS

| | | | |
|---|---|---|---|
| 813,455 | 2/1906 | Scheel | 292/39 X |
| 1,035,531 | 8/1912 | Cobb | 292/39 |
| 1,179,731 | 4/1916 | McDonald | 292/39 |
| 2,393,788 | 1/1946 | Lofgren | 292/39 X |
| 4,002,360 | 1/1977 | Frank et al. | 292/336.3 |
| 4,063,763 | 12/1977 | Van Herpen | 292/39 |

*Primary Examiner*—Richard E. Moore

*Attorney, Agent, or Firm*—Larson & Taylor

[57] ABSTRACT

A fastener 1 has two elongate bars 2,3 slidably mounted in a guide track 4 for simultaneous displacement longitudinally thereof in opposite directions under the action of a rotatable handle 6. Each bar 2,3 has an associated rack and pinion assembly 7,8 for transposing rotation of the handle 6 into linear displacement of the bar.

12 Claims, 2 Drawing Figures

FASTENERS FOR DOORS, WINDOWS AND THE LIKE

BACKGROUND OF THE INVENTION

This invention concerns improvements in fasteners for doors, windows and the like, and in particular fasteners of the type in which simultaneous longitudinal displacement of two bars in opposite directions is used to provide a fastening action to secure two members mounted for relative movement in a closed position.

In one fastener of the type specified, called an espagnolette, the bars comprise bolts mounted on one of the members and the fastening action is provided by moving the bolts to engage/disengage holes in or strikers attached to the other of the members to be secured.

In another fastener of the type specified, called a cremonne, the bars comprise apertured rails mounted on one of the members and the fastening action is provided by moving the rails to engage/disengage headed studs attached to the other of the members to be secured.

The known fasteners of the type specified, whether espagnolette, cremonne or any other kind, have a drive mechanism operable by a handle to displace the bars and various constructions of drive mechanism are known which will effect the required simultaneous displacement of the bars in opposite directions.

However the known drive mechanisms are often complex and in certain instances too large to be accomodated within the space available for mounting the fastener. This a particular problem where the fastener is to be mounted on a frame member consisting of a relatively thin and narrow extrusion.

SUMMARY OF THE INVENTION

It is an object of the present invention to provide a fastener for doors, windows and the like of the type specified which mitigates the above-mentioned disadvantage of the known fasteners.

According to the present invention a fastener for a door, window and the like comprises first and second bars and a drive mechanism operable by an actuator to displace the bars simultaneously in opposite directions to provide a fastening action wherein the drive mechanism comprises a respective rack and pinion assembly for each bar of which the respective racks are provided on the bars and the respective pinions are adapted for rotation simultaneously in opposite senses.

By this arrangement a simple and compact drive mechanism is provided which is reliable in operation and capable of installation in a wide range of applications. Furthermore, the use of a respective rack and pinion assembly for each bar results in a positive drive which enables movement of the bars to be controlled in a precise manner to obtain a smooth and balanced fastening action.

Preferably the pinions are interconnected by one or more idler sprockets such that rotation of one pinion causes rotation of the other pinion in the opposite sense. Conveniently one pinion is mounted on and rotatable with an axle and the other pinion is mounted on and rotatable relative to the axle with the idler sprocket(s) positioned inbetween.

The pinions and idler sprocket(s) are preferably housed in a casing provided with aligned holes for rotatably mounting the ends of the axle. Preferably the casing is formed in two halves provided with complementary internal formations for locating the idler sprocket(s).

The racks are conveniently arranged in side-by-side relationship on longitudinally extended portions of the adjacent inner ends of the bars and the pinions project through an opening in the casing for engagement with the associated rack.

Preferably the fastener includes guide means for the bars, for example one or more runners may be provided at spaced intervals along the length of each bar, the precise number depending on the length of the bars. Alternatively the bars may be mounted on a guide track.

The fastening action may be provided in a number of ways, for example the fastener may be of the espagnolette type in which the bars comprise bolts which in use are mounted on one of two members mounted for relative movement for engagement with a respective recess in or striker on the other of the members. The engagement may be provided by the outer ends of the bolts and/or by one or more projections located at spaced intervals along the length of each bolt which are advanced/retracted to engage respective recesses or strikers. The engagement may further be arranged to provide a cam action so that the members are drawn tightly into the closed position. For example the outer ends of the bolts and/or projections thereon may have ramp surfaces for engagement with similar ramp surfaces of the associated recess or striker. The ramp surfaces may be provided by inclined flats or by rollers.

Alternatively, the fastener may be of the cremonne type in which the bars comprise apertured rails which in use are mounted on one of two members mounted for relative movement for engagement with headed studs on the other member. The apertures may be key-hole shaped in known manner.

The bars may have any cross-section, e.g. rectangular, square, circular, oval etc., and be of any length to suit a particular application.

The invention will now be described in more detail, by way of example only, with reference to the accompanying drawings wherein:

DETAILED DESCRIPTION OF THE EXEMPLARY EMBODIMENT

Figure 1:
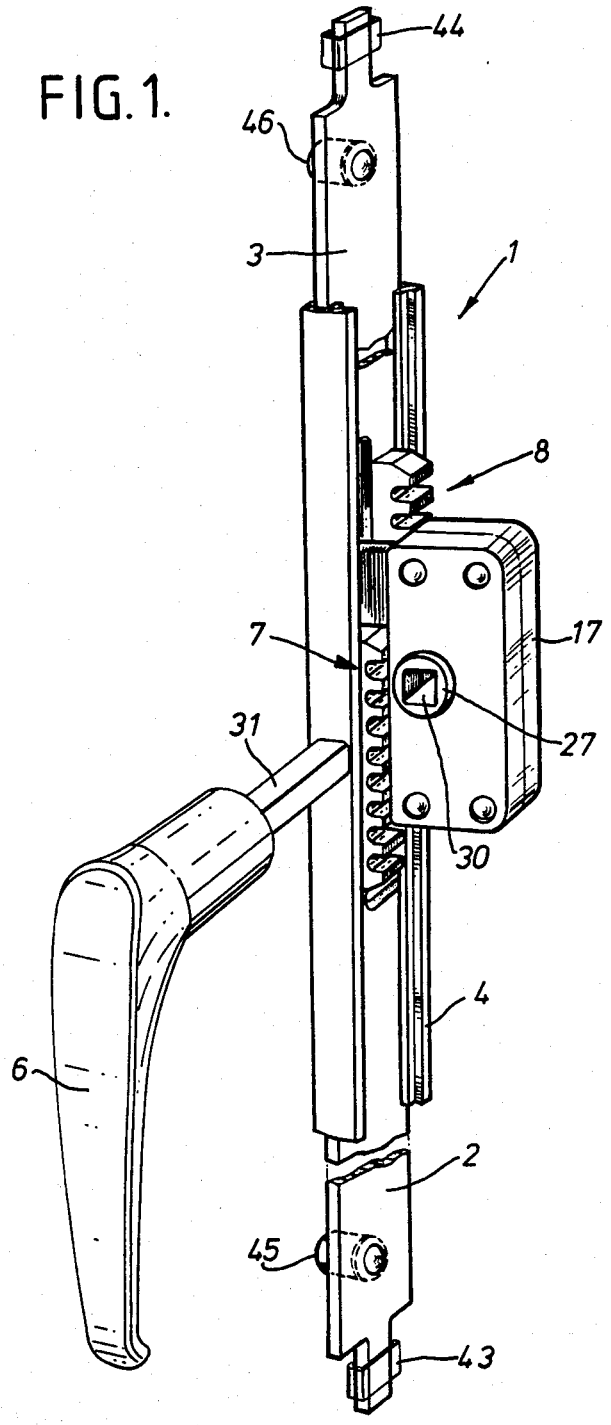
FIG. 1 is a perspective view of a fastener according to the present invention.
Figure 2:
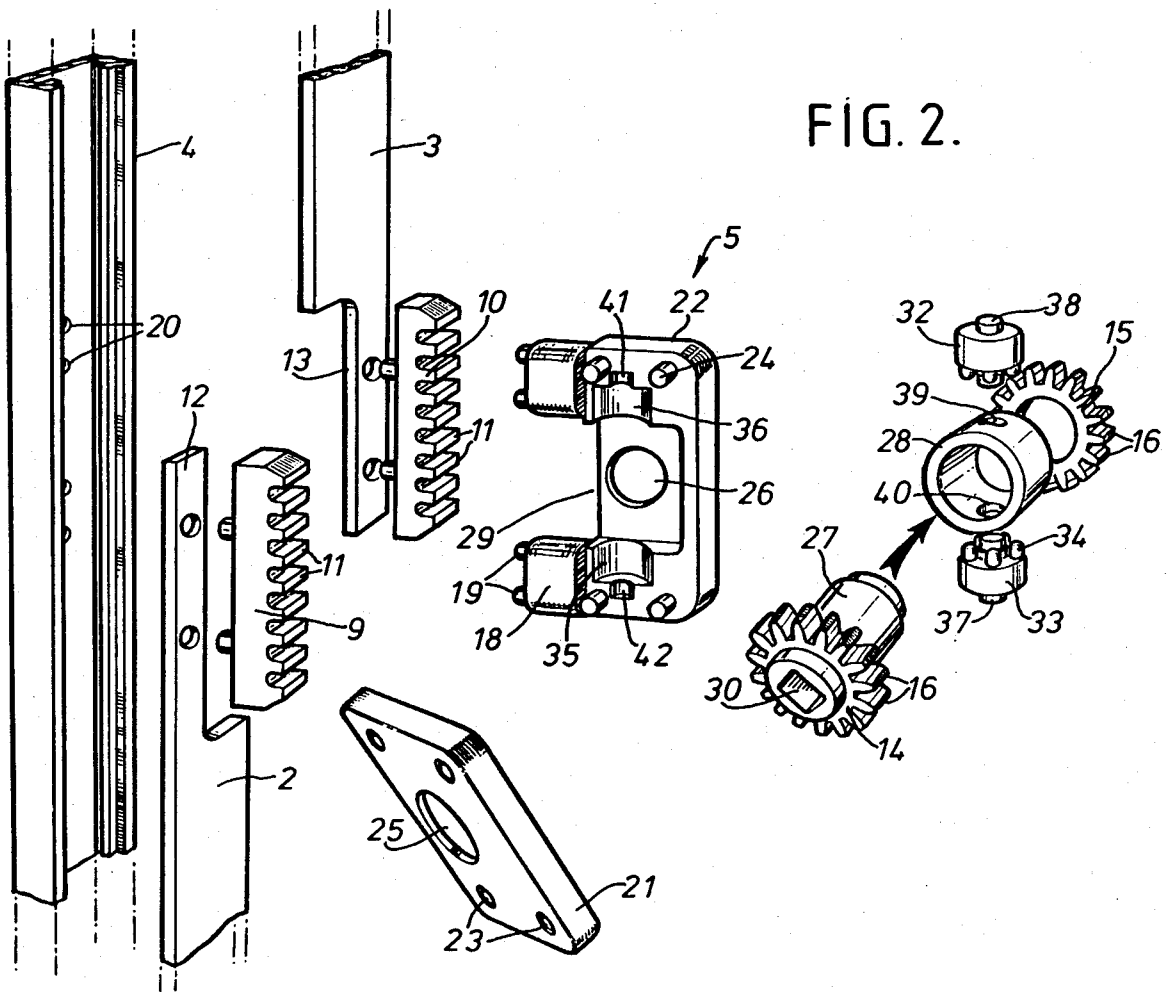
FIG. 2 is an exploded perspective view of the drive mechanism of the fastener shown in FIG. 1.

Referring to the accompanying drawings, there is shown an espagnolette fastener 1 comprising first and second elongate bolts 2 and 3 respectively of rectangular cross-section slidably mounted within a channel-section guide track 4 and a drive mechanism 5 operable by a rotatable actuator handle 6 to effect simultaneous movement of the bolts 2,3 in opposite directions, i.e. towards or away from one another, to provide a fastening action.

The drive mechanism 5 comprises a respective rack and pinion assembly 7,8 for each bolt. The racks 9,10 have equal numbers of teeth 11 and are mounted in side-by-side relationship on longitudinally extended portions 12,13 of the adjacent inner ends of the bolts. The pinions 14,15 likewise have equal numbers of teeth 16 and are housed within a casing 17 located on the guide track 4 by feet 18 positioned between the extended portions 12,13 and provided with lugs 19 received in holes 20 in the base of the guide track.

The casing 17 is formed in two halves 21,22 located relative to one another by complementary formations 23,24 formed integrally therewith. Each casing half 21,22 is formed with a central aperture 25,26 respectively in which the ends of an axle 27 are rotatably received. The pinion 14 is formed integrally with the axle 27 and the pinion 15 is mounted on the axle 27 for rotation relative thereto with a cylindrical spacer 28 interposed between the pinions 14,15. The casing halves 21,22 define a rectangular opening 29 through which the teeth 16 of the pinions 14,15 project and mesh with the teeth 11 of the associated rack 9,10. One end of the axle 27 is formed with a blind bore 30 of square cross-section in which a square section spindle 31 connected to the handle 6 is located.

Also housed within the casing 17 are two similar idler sprockets 32,33 having equal numbers of teeth 34 which mesh with the teeth 16 of the pinions 14,15 for transmitting drive from the pinion 14 to the pinion 15. Each sprocket 32,33 is located in an annular socket 35,36 respectively defined by the casing halves 21,22 and is formed integrally with an axle 37,38 respectively. One end of each axle 37,38 is located in a respective one of two diametrically opposed holes 39,40 in the spacer 28 and the other end is located in a respective blind bore 41,42 defined by the casing halves 21,22.

As will be apparent from the foregoing description of the drive mechanism 5, rotation of the handle 6 in one sense causes rotation of the axle 27 and pinion 14 in the same sense and simultaneous rotation of the pinion 15 in the opposite sense via the idler sprockets 32,33. This rotation of the pinions 14,15 is transformed into linear movement of the bolts 2,3 by the engagement of the pinions 14,15 with the associated racks 9,10 with the result that the bolts 2,3 are either advanced or retracted simultaneously.

In use the fastener 1 is mounted along one side of a movable member (not shown), for example a door or casement, mounted for hinged, pivotal or sliding movement relative to a fixed frame member (not shown) and the bolts 2,3 advanced/retracted to engage/disengage the outer ends thereof in strikers 43,44 respectively mounted on the fixed frame member to secure the members in a closed position. Additionally, each bolt 2,3 has adjacent to the outer end thereof a roller 45,46 respectively which simultaneously engage/disengage ramp surfaces provided by inclined flats (not shown) on the fixed frame member to draw the members tightly into the closed position.

It will be understood that by providing a respective rack and pinion assembly for each bolt and arranging for the drive to be transferred from one assembly to the other, simultaneous and equal movement of the rails in opposite directions is assured. As a result, the forces generated by the fastening action are completely balanced and there is no tendency for the movable member to be displaced to one side relative to the fixed frame member.

It will further be appreciated that the invention provides an extremely simple and compact drive mechanism which is reliable in operation and results in a relatively slim and narrow fastener which can be easily installed in a wide range of applications.

The embodiment above-described may be modified in a number of ways, for example the length and cross-section of the bolts may be varied to suit any application.

Each rack and pinion assembly of the drive mechanism may be modified to provide any desired range of movement for the associated bolt. The racks may be attached to the bolts as described or formed integrally therewith. One idler sprocket only may be used to transmit the drive from one pinion to the other pinion. The idler sprockets may be replaced by any other means for transmitting the drive.

The guide track may be replaced by one or more runners positioned at appropriate intervals along the length of each bolt.

The fastening action may be provided by the ends of the bolts alone or by the rollers alone depending on the size of the members to be secured and the clearance therebetween.

The rollers may be provided on the bolts as described or on the adjacent fixed frame member with the inclined flats being on the bolts. More than one roller or inclined flat may be provided on each bolt but there should preferably be equal numbers of rollers or inclined flats on each bolt and located at similar positions to ensure the forces generated by the fastening action are balanced.

The rollers may be replaced by projections which may be shaped to provide a cam action to draw the members tightly into the closed position.

The fastener may be used in combination with any other type of lock or fastening device as required, for example the handle may include a cylinder lock to prevent rotation of the handle when the bolts are advanced to secure the members in the closed position. Alternatively a deadlock may be provided to lock the members in the closed position.

Although the invention has been described with particular reference to an espagnolette fastener it will be understood that the drive mechanism has application to any fastener of the type in which simultaneous displacement of two bars in opposite directions is used to provide a fastening action. For example, the fastener may be of the cremonne type in which the bolts are replaced by apertured rails for engagement with headed studs in known manner.

Finally it will be understood that the fastener may be secured to the movable member, i.e. door, casement and the like, as above-described or to the fixed frame member.

I claim:

1. A fastener for a door, window and the like comprising first and second elongate bars mounted for displacement longitudinally thereof, a drive mechanism comprising a respective rack and pinion assembly for each of said bars of which the respective racks are provided on the bars and the respective pinions are mounted for rotation about a common axis, a rotatable actuator connected to said first pinion for effecting rotation of said first pinion in one sense, and means connecting said second pinion to said first pinion for effecting simultaneous rotation of said second pinion in the opposed sense whereby said bars are simultaneously displaced in opposite directions on rotation of said actuator to provide a fastening action.

2. A fastener according to claim 1 wherein said means connecting said second pinion to said first pinion comprises at least one idler sprocket.

3. A fastener according to claim 1 wherein said bars are located for displacement longitudinaly thereof by guide means.

4. A fastener according to claim 2 wherein said first pinion is mounted on and rotatable with an axle and said second pinion is mounted on and rotatable relative to said axle.

5. A fastener according to claim 4 wherein said actuator comprises a rotatable handle operatively connected to said axle.

6. A fastener according to claim 4 wherein said pinions and idler sprocket(s) are housed in a casing.

7. A fastener according to claim 6 wherein said casing is provided with aligned holes for rotatably mounting opposed ends of said axle and an opening through which said pinions project to engage the associated rack.

8. A fastener according to claim 6 wherein said casing is formed in two halves provided with complementary internal formations for locating said idler sprocket(s).

9. A fastener according to claim 1 wherein said racks are arranged in side-by-side relationship on longitudinally extended portions of adjacent inner ends of said bars.

10. A fastener according to claim 9 wherein said racks are formed integrally with the associated bar.

11. A fastener according to claim 1 wherein said bars are of rectangular cross-section.

12. A fastener according to claim 3 wherein said guide means comprises a guide track on which said bars are mounted.

* * * * *